US006266898B1

(12) United States Patent
Cheng

(10) Patent No.: US 6,266,898 B1
(45) **Date of Patent: *Jul. 31, 2001**

(54) AIR-CIRCULATING, SHOCK-ABSORBING SHOE STRUCTURES

(76) Inventor: Peter S. C. Cheng, 99 Glencairn Avenue, Toronto, Ontario (CA), M4R 1M7

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/233,861

(22) Filed: Jan. 20, 1999

Related U.S. Application Data

(62) Division of application No. 08/882,585, filed on Jun. 25, 1997, now Pat. No. 6,041,519.

(51) Int. Cl.[7] ..... A43B 13/18; A43B 13/20; A61F 5/14; A63B 39/00; A47C 27/08

(52) U.S. Cl. ..... 36/29; 36/28; 36/35 R; 36/35 B; 36/37; 36/3 B; 36/141; 156/145; 5/706; 5/707; 5/711

(58) Field of Search ..... 36/29, 28, 43, 36/35 R, 35 B, 37, 3 B, 141, 153; 156/147, 145, 292, 29; 428/72, 69, 178; 137/223, 225; 2/239, 22; 5/707, 706, 711, 655.3, 655.5

(56) References Cited

U.S. PATENT DOCUMENTS

| | | | | |
|---|---|---|---|---|
| 4,471,538 | * | 9/1984 | Pomeranz et al. | 36/28 |
| 4,547,978 | * | 10/1985 | Radford | 36/3 B |
| 4,768,295 | * | 9/1988 | Ito | 36/28 |
| 4,831,749 | * | 5/1989 | Tsai | 36/3 B |
| 5,134,790 | * | 8/1992 | Woitschaetzke et al. | 36/28 |
| 5,274,846 | * | 1/1994 | Kolsky | 2/2 |
| 5,655,314 | * | 8/1997 | Petracci | 36/3 B |
| 5,753,061 | * | 5/1998 | Rudy | 36/29 |
| 5,784,807 | * | 7/1998 | Pagel | 36/28 |
| 5,915,819 | * | 6/1999 | Gooding | 36/29 |

* cited by examiner

*Primary Examiner*—Paul T. Sewell
*Assistant Examiner*—Anthony Stashick
(74) *Attorney, Agent, or Firm*—Kirschstein et al.

(57) ABSTRACT

A structure for ventilating a toe region of a shoe includes a body including in its heel zone two major walls and a resilient element having a multitude of voids arranged in a pumping chamber to urge the two walls apart against the action of external forces tending to draw air into the chamber. The resilient element includes a plurality of substantially dome-shaped hollow protuberances bounding respective first and second voids within and outside of them, respectively, and connecting portions that interconnect the protuberances. Respective connecting channels are provided in the connecting portions and in respective adjacent regions of the protuberances to establish communication between the first voids. A corrugated insert within the body aids ventilation and shock absorption. An extension on the body optimizes air transfer.

4 Claims, 3 Drawing Sheets

AIR-CIRCULATING, SHOCK-ABSORBING SHOE STRUCTURES

CROSS REFERENCE TO RELATED APPLICATIONS

This application is a division of U.S. patent application Ser. No. 08/882,585, filed Jun. 25, 1997, now U.S. Pat. No. 6,041,519.

BACKGROUND OF THE INVENTION

1. Field of the Invention

The present invention relates to shoes, especially athletic shoes, in general, and more particularly, to structures for circulating air and absorbing shocks encountered when wearing such footwear.

2. Description of the Related Art

There are already known various constructions of shoes, among them athletes' footwear and their not-too-distant relatives, the ever-popular "sneakers". While even "fully enclosing" shoes or boots, that is those having natural or artificial material uppers, perform to satisfaction as far as air access to various parts of the foot of the wearer is concerned when such footwear is used for normal day-to-day activities, there are circumstances, such as when footwear such as the aforementioned sneakers is used in more strenuous activities or, for all intents and purposes, at all times when athletic footwear is being used in sports and similar activities, when the air circulation especially in the toe region of the shoe is simply inadequate to properly deal with the problem of accumulating moisture (sweat) at the affected region.

Attempts have been made to address this issue, be it by arranging "breathing" (i.e., permeable fabric) inserts at, or by providing perforations in, the zones of the shoe uppers adjacent such regions. Yet, experience has shown that, while these measures may not be absolutely worthless, their effectiveness and efficacy leave much to be desired. This is primarily so because, as has been realized during the contemplation of the present invention, there is not much to compel air to actually flow through such permeable fabric inserts or perforations in and out of the toe region. Of course, the situation is somewhat different as far as the instep area of the foot arch region is concerned, especially since the curvature of the foot arch changes as the foot moves even while walking, so that such inserts or perforations can frequently be found in sneakers and athletic footwear at such areas of the shoe uppers. This, however, does not do anything for ventilation of the toe region of the wearer's foot where the problem of moisture accumulation is perhaps most acute.

Nor are fabric inserts very useful in absorbing shocks or forces encountered by the feet during wearing the footwear. There are already known various shoe inserts, including air-filled tubes or resilient cushions, that tend to absorb or mitigate at least part of the shock force. However, experience has shown that the air-filled tubes do not provide sufficient give, and that the cushions provide too much give, so that their usefulness is not altogether satisfactory.

OBJECTS OF THE INVENTION

Accordingly, it is a general object of the present invention to avoid the disadvantages of the prior art.

More particularly, it is an object of the present invention to provide an air circulation and shock absorption structure for a shoe that does not possess the drawbacks of the known structures of this type.

Still another object of the present invention is to devise a shoe ventilation structure of the type here under consideration which would render it possible to move air in and out of the toe region of the interior of the shoe in question while the latter is being worn by a user.

It is yet another object of the present invention to design the above ventilating structure in such a manner as to actually pump air into and/or out of the affected region.

Another object of the present invention is to provide an effective shock absorbing structure for a shoe.

A concomitant object of the present invention is so to construct the ventilating structure of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a structure for ventilating a toe region of a shoe. This structure includes a body that is substantially coextensive with an inwardly facing surface of a sole of the respective shoe and having a toe zone, a heel zone, a ball zone, an arch zone between the ball and heel zones, and respective lateral zones.

In accordance with the present invention, the heel zone of the body includes two major walls arranged in mutually facing relationship, and circumferential walls interconnecting the major walls and bounding an enclosed pumping chamber with them. At least one of these major walls is flexible to be able to yield into and out of the chamber in response to a rise and fall in the magnitude of external forces acting thereon with attendant increase and decrease in the pressure of air contained in the pumping chamber. In further accord with the present invention, there is further provided conduit means in the body for establishing air flow paths between the toe region and one of the lateral zones of the body, this conduit means including an elongated estuary section opening at least onto a lateral surface of the one lateral zone.

To finalize this overall description of the present invention, it is to be mentioned that there is further provided means for injecting air from the pumping chamber, when the pressure in the latter exceeds the ambient pressure, substantially axially and in a direction toward the lateral surface, into the estuary section for entraining the previously stationary air present in the estuary section for joint travel therewith and hence for drawing replenishment air out of the toe region of the shoe into and through the conduit means. A particular advantage of the arrangement of the present invention as described so far is the flow amplification effect obtained by injecting the usually high-speed and hence high-energy jet of air from into the estuary section where it dramatically increases the volume of air being drawn through the conduit means and hence out of the toe region of the shoe.

According to another aspect of the present invention, the ventilating structure further includes a resilient element arranged substantially coextensively in the pumping chamber and having a multitude of voids. This resilient element is operative for urging the two major walls away from one another against the action of the external forces thereon but, because of the presence of the voids in it, still leaves enough space of the pumping chamber empty for the effective and efficient performance of the pumping action.

Advantageously, the resilient element includes a plurality of substantially dome-shaped hollow protuberances bounding respective first and second voids within and outside of them, respectively, and connecting portions that interconnect the protuberances. It is further advantageous in this context when there is further provided means for bounding respective connecting channels in the connecting portions and in respective adjacent regions of the protuberances for such connecting channels to establish communication between the first voids so that the pressure in such first voids rises and falls substantially in unison. The protuberances are arranged in staggered rows and, as a group, collectively perform a shock-absorbing function.

Another advantageous feature of the present invention is to be found in the fact that the injecting means includes a tube embedded in the body and bounding an internal passage opening into the pumping chamber on one end and into the estuary section on the other.

A further advantageous facet of the present invention involves the provision of additional conduit means connecting the toe region of the shoe with the pumping chamber. In this connection, it is also advantageous to associate one-way flow-control means with the additional conduit means in such a manner that it permits air to flow through the additional conduit means in a direction from the toe region of the shoe to the pumping chamber but not in the opposite direction. A particularly advantageous construction of such flow control means is obtained when it includes a flexible flap valve arranged at that end portion of the additional conduit means that opens onto a seat surface located in the pumping chamber and cooperating with the seat surface to control the flow through the additional conduit means in dependence on the sense of an air pressure differential between the pumping chamber and the second conduit means.

Yet another feature of the present invention resides in routing the air flow paths of the conduit means around peripheral marginal edge regions of the structure, leaving the ball zone available to receive a corrugated element between the major walls. The corrugated element is sinuous in cross-section and has a plurality of elongated linear air channels arranged in mutual parallelism lengthwise of the insert. This element, advantageously fused, glued or otherwise connected to one or both major walls at the ball zone not only provides additional air flow paths for increased ventilation, but also acts as a shock absorber.

As previously mentioned, the air flow paths are open at a lateral surface of at least one of the lateral zones of the insert, especially at the arch zone where the curvature of the foot arch changes as the foot moves, thereby allowing air to enter and exit. For increased ventilation, it is an additional feature of the present invention to form an elongated flexible extension at the arch zone which is placed along the inner side wall of a shoe. The air flow paths extend into and along the extension and open onto an external location of the shoe, thereby optimizing the flow of air into and out of the shoe.

Last but not least, it is to be mentioned that the aforementioned body is advantageously constructed as a discrete insert separate and apart from the affected shoe proper but arranged prior to and during the use thereof at the proper location within the internal space of the affected shoe.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
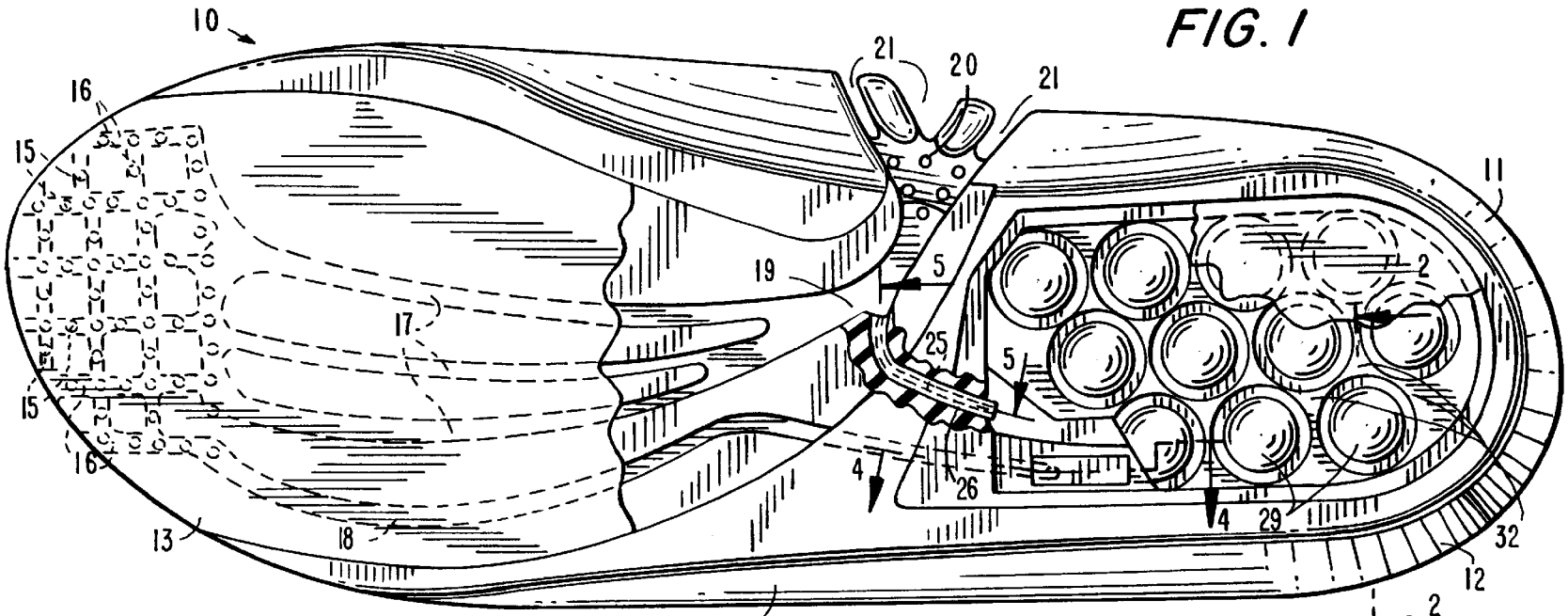
FIG. 1 is a bottom plan view of a shoe insert constructed and equipped in accordance with one embodiment of the present invention, with parts broken away to reveal internal elements, especially a built-in pumping member.

Referring now to the drawing in detail, and first to FIG. 1 thereof, it may be seen that the reference numeral 10 has been used therein to identify a resilient structure that is designed to act as a shock absorber and/or to give comfort to the user of a shoe, boot or other footwear article provided with such a structure 10. This structure 10 will be described below as being embodied in a member or body 11 separate from the footwear article proper but inserted, when in use or ready for being used, into the interior of such an article. Due to such positioning, the body 11 will be referred to below as a shoe insert. However, it is to be mentioned at the very outset that the principles involved and measures taken in conjunction with this separate shoe insert could just as well be incorporated directly into the sole of a footwear article, in which case no insert whatsoever, or just a regular insert of a well-known construction, would be used in that particular type of footwear article. Regardless of whether the separate or the incorporated construction of the structure 10 is chosen, the body 11 has a back or heel zone 12, a front or toe zone 13, and an intermediate or arch zone 14.

As mentioned before, one of the main issues that have not yet been fully satisfactorily addressed in footwear, especially in athletic footwear, is proper ventilation. While at least athletic footwear, but also certain other footwear, especially that resembling the same, for instance the well-known sneakers that are being used by children and adults alike for the comfortable feeling they offer even if used in other than athletic activities, is made in such a manner that it "breathes", i.e. that at least some air exchange takes place between the interior and the exterior of the shoe either through the material of the shoe uppers or through holes strategically provided in the footwear for this purpose, experience with hitherto proposed footwear of this type has shown that the ventilation effect achieved in it leaves much to be desired, especially as far as the area that is particularly vulnerable to the deleterious consequences of the combination of insufficient ventilation and moisture accumulation (from sometimes profuse sweating), namely the toe area, is concerned. As is well known, such unwanted consequences include, but are not limited to, creating the conditions conducive to the development and/or progression of an affliction commonly referred to as athlete's foot.

Analysis of and experience and experiments with existing athletic footwear types has shown that one of the main reasons why the area in question is not properly ventilated even if the athletic shoe is abundantly perforated at that region is the total lack of relative movement of the toes within the space allotted to them in the interior of the shoe with respect to the shoe itself, or at best an amount of such movement that is inadequate for forcing any meaningful amount of air in and out through the perforations, if any, provided at that region even if the shoe is rather loose fitting. The airing situation is obviously even worse when the shoe is tied tight, as athletic footwear used in sports and similar outdoor or indoor activities would be in order to assure a secure foothold by making sure that the shoe accurately follows all movements of the respective foot at least when in contact with the ground.

The main purpose of the present invention is, as alluded to before, to provide for at least adequate if not excellent circulation of air in the interior of the shoe while being worn, and especially into and out of the interior region that accommodates the toes of the shoe wearer. To this end, the body 11 is provided, at its front zone 13, with a multitude of orifices 15 that are shown to be arranged in an array of respective substantially orthogonal rows and columns. One end of each of these orifices 15 opens onto the surface of the body 11 of the shoe insert 10 (or, as will be mentioned for the last time here, of the shoe sole if the present invention is incorporated in it) that faces the foot of the shoe wearer, while the other end opens into a respective one of several ducts 16 provided in a similarly orthogonal fashion in the interior of the body 11.

These ducts 16, in turn, are in communication with respective first and second conduits 17 and 18. As shown, there are three of the first conduits 17 but only a single second conduit 18. The first conduits 17 lead from the ducts 16 to the central zone 14 where they gradually merge with one another to eventually form a common conduit 19 that leads from the center of the body 11 to its (instep) side where it opens onto the aforementioned foot-facing surface through respective ports 20 and, possibly even more importantly, onto the side surface of the body 11 through respective mouths 21.

The common conduit 19 and the ports 20 and mouths 21 together form something that will occasionally be referred to as an estuary section. It may be seen that the orifices 15, the ducts 16, the first conduits 17, the common conduit 19, and the ports 20 and mouths 21 jointly form respective communicating pathways through which the aforementioned toe region of the interior of the shoe is in communication with the instep side region of such interior and, if this region is connected through respective perforations in the shoe upper with the outside of the shoe, as it usually is at least in athletic footwear, with the exterior of the shoe as well.

Figure 2:
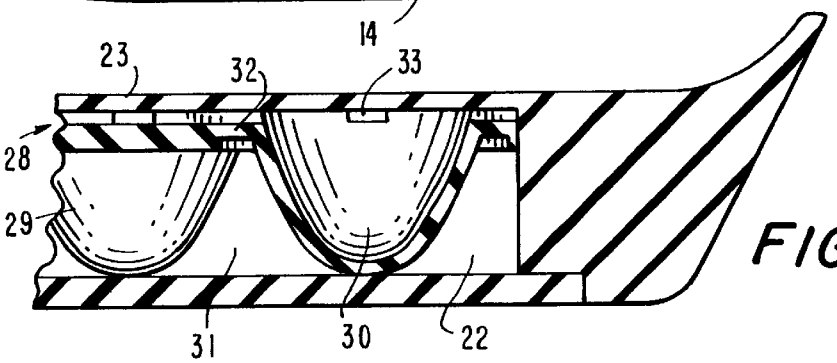
FIG. 2 is a sectional view taken along line 2—2 through a fragment of the shoe insert of, and at a scale enlarged relative to that of, FIG. 1.

The second conduit 18, on the other hand, leads from the ducts 16 through the arch zone 14 all the way to the heel zone 12. As a comparison particularly of FIGS. 1 and 2 of the drawing will reveal, the second conduit opens into a recess 22 provided in the heel zone 12 of the body 11 and delimited on one of its major sides (as shown that facing toward the foot of the wearer) by an integral wall 23 of the body 11. That recess 22 is covered at its side facing away from the shoe wearer in the use condition, in a substantially hermetically sealing manner, by a cover sheet or wall 24. That effectively converts the recess 22 into an enclosed compartment that is separated from the exterior of the body 11, so that the air pressure in it or in any part of it may differ from that prevailing at such exterior. Of course, the compartment 22 is not totally separated from the environment. For one, as mentioned just above, it communicates, at least at time as will be explained later, with the second conduit 18. Moreover, it is connected, via a passage 25 that is provided in a substantially rigid tube 26 embedded in the material of the arch zone 14 of the body 11, with the common conduit 19.

It may be seen from the above that the toe region of the interior of the shoe provided with the structure 10 is connected through the conduits 17 and 18, directly or indirectly, with the instep side region of the body 11. The presence of the conduits 17 and 18 in and of itself does not assure that any circulation or movement of air will take place through them, though. As a matter of fact, without further measures being taken, any movement of air through the conduits 17 and 18 would be so minuscule as to be totally insignificant in the scheme of things, and the ventilation effect would hardly, if at all, be improved over that obtained by means of the aforementioned perforations in the shoe upper, even if the conduits 17 and 18 were provided in addition to such perforations.

This, however, is where the present invention comes in, in that at least one of the walls 23 and 24, but preferably both, is flexible enough to yield to a certain extent when subjected to forces trying to displace it toward the other of the walls 24 and 23. It should be evident that such forces are in existence at all times that the weight of the shoe wearer rests on the heel zone 12 of the insert or body 11, but that the magnitude of such forces will vary in dependence on the movements of the wearer —from a minimum encountered when the heel portion of the shoe is lifted off of the ground to a maximum occurring, for instance, right after the heel portion has touched the ground after the wearer has, for instance, jumped up in the air in the course of a basketball game. Combined with the presence of the conduit 18 and the passage 26 and one or more additional measures, this wall flexibility makes a pumping chamber out of the compartment 22.

Figure 5:
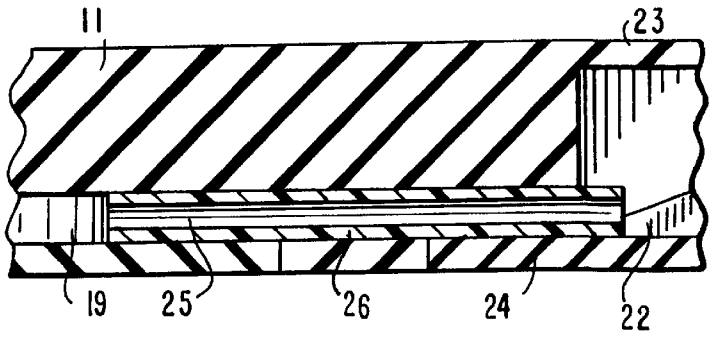
FIG. 5 is another substantially correspondingly scaled sectional view but taken through another fragment of the shoe insert, this time on line 5—5 of FIG. 1.
Figure 4:
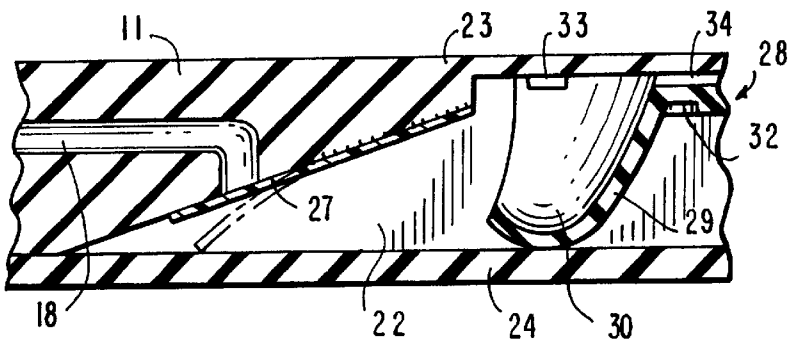
FIG. 4 is a sectional view, at an enlarged scale substantially corresponding to that of FIG. 2, of another fragment of the shoe insert of FIG. 1, taken on line 4—4 thereof.

One of such additional measures is illustrated in FIG. 4 of the drawing. It involves the provision of a one-way valve 27 in or at the passage 18. As shown, the valve 27 is constructed as a flap valve that permits air to flow out of the conduit 18 into the compartment 22 when the air pressure in the conduit 18 exceeds that prevailing in the compartment 22, but not the other way around. This, of course, means that the only avenue left for the air to escape from the compartment 22 when the pressure in it exceeds that existing outside the body 11 is through the passage 25 provided in the tube 26 and extending longitudinally of the latter as depicted in particular in FIG. 5 of the drawing, and hence into the common conduit 19. On the other hand, when the pressure in the compartment 22 is lower than the ambient pressure, the higher-pressure air from the second conduit 18 is able to flow into the compartment or pumping chamber 22 after it has opened the flap valve 27 due to its dominant pressure.

Figure 3:
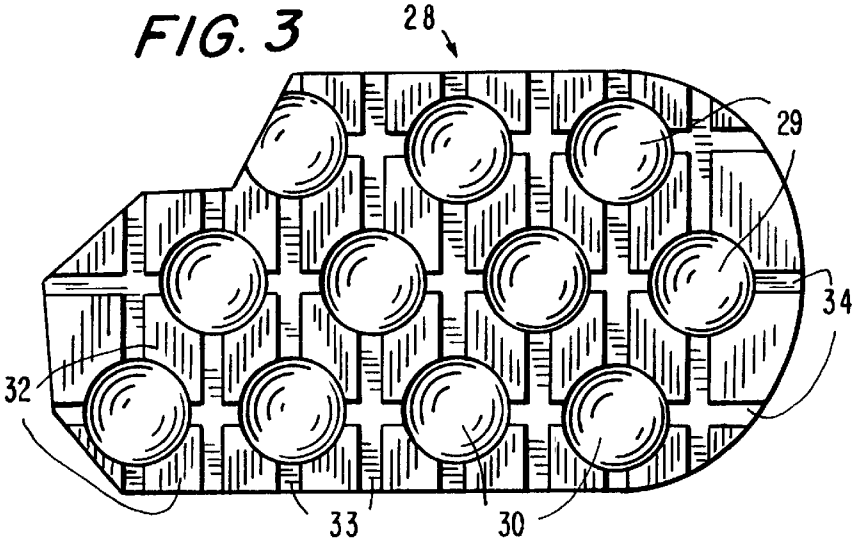
FIG. 3 is a top plan view of the pumping and shock-absorbing member depicted in FIG. 1, at a scale substantially corresponding to that of FIG. 1.

This pumping action would be present at least to some extent even if the pumping chamber 22 were devoid of any internal elements. When, however, FIG. 1 is considered together with FIG. 3 of the drawing, it may be seen that the compartment or chamber 22 is not empty; rather, a resilient element 28, preferably constituted of a thin elastomeric material, is located in it and, as a matter of fact, substantially fills it to the extent that it itself does not have respective voids within its overall outline. As may be observed especially in FIG. 2, particularly if considered in conjunction with FIGS. 1 and 3, there is a considerable amount of such voids inasmuch as the resilient element 28 includes respective substantially dome-shaped, spaced-apart, dimples or protuberances 29 that are hollow to bound a first kind of such voids 30. Of course, the oppositely facing external surfaces of the resilient element 28 bound a substantially complementary set of a second kind of voids designated as 31, but these latter voids 31 are of somewhat lesser significance in the context of the present invention than the voids 30.

It may be seen that the protuberances 29 "rise above" respective connecting portions 32 that are interposed between them and connect them with one another. These connecting portions 32 and the adjacent regions of the protuberances 29 are provided with respective channels 33 and 34 that connect the first voids 30 so that the pressure in them will rise and fall substantially in unison. It may also be seen especially in FIG. 3 of the drawing that the resilient element 28 is provided with a cutaway at a region corresponding, as may be observed in FIG. 1 of the drawing, to the location of the flap valve 27, so that it does not interfere with the operation of the latter. Even though this is not particularly shown in the drawing, it ought to be realized that the resilient element 28 may be, and advantageously will be, secured in place, for instance by its connecting portions 32 being connected by a layer of adhesive to the wall 23 of the body 11.

Advantageously, the protuberances are arranged in longitudinal rows that are staggered relative to adjacent rows. The channels 33 are linear and extend longitudinally along each row, and transversely across adjacent rows.

Now that the basic construction of the structure 10 has been described in some detail, the function and operation of this structure 10 will now be described. As mentioned above, when ready for use or actually used (the latter condition being assumed in the following explanation), the body 11 is located in the interior of the shoe in question, and more particularly next to (or, as mentioned at the outset, within) the shoe sole, i.e. underneath a standing shoe wearer's foot. The various parts of the structure 10 assume their relative positions shown in the drawing only when none of the weight of the wearer rests on the wall 23. Under these circumstances, the volumes of the voids 30 and 31 and hence the free volume of the pumping chamber 22 are at their maxima.

Once, however, at least a part of the weight of the user starts resting on the wall 23, the latter and/or the wall 24 start to be pushed in and, because of its or their flexibility, one or both of them yield into the chamber 22, thus diminishing its volume. It should go without saying that this inward flexing is resisted by the dome-shaped protuberances 29 of the resilient element 28; however, since the resilient element 28 is, by definition, resilient, the protuberances 29 will yield out of the way of relative movement of the respective flexible wall 24, thus diminishing the volumes not only of the first voids 31 but those of the second voids as well.

As will be readily apparent to those familiar with the behavior of resilient materials, this protuberance deformation process is accompanied by accumulation of energy in the material of the resilient element 28. This, of course, means that once the magnitudes of the weight-related forces acting on the walls 23 and 24 are diminished, this accumulated energy causes the protuberances 28 to move toward their initial positions and/or configurations, hence pushing the walls 23 and 24 apart. Thus, it may be seen that the resilient element 28 has, if no other, then the function of acting as a "spring" that urges the walls 23 and 24 toward their relative positions in which the volume of space enclosed in the chamber 22 is at its maximum.

The rises and falls in the pressure of the air contained in the pumping chamber 22, which attend the increase and decrease in the weight-related forces acting on the walls 23 and 24 present at the heel zone 12 of the body 12, have the following consequences: starting with the assumptions that the effective volume of the chamber 22 is significantly less than that shown in the drawing, with the walls 23 and 24 being much closer to one another than shown there, and that the weight-related forces are already diminishing after having achieved their momentary peaks, the pressure in the pumping chamber 22 is diminishing as well due to the pushing-apart action of the resilient element 28 and the attendant increase in the volumes of at least the voids 30. This means that the flap valve 27 will open, and air will be drawn into the compartment 22 from the toe region through the orifices 15, the ducts 16, and the second conduit 18, in that order.

Now, it is possible that some of the "replacement" air will come from the first ducts 17 at this stage of the game, but that possibility need not be taken into account in judging the overall performance of the ventilation system of the present invention. This is so because the more significant part of the air circulation process takes place during the "downstroke", i.e. as the volume of, and hence the pressure in, the compartment 22 rises, often at a very rapid pace, especially after the wearer has landed on the heel portion of the shoe after having jumped up to a more or less considerable extent. What happens then is that the rising pressure in the compartment 22 causes the flap valve 27 to close and the high-pressure air contained in the pumping chamber 22 is forced to flow only through the passage 25 of the tube 26.

On the first glance, this direct expulsion of the air from the compartment 22 into the common conduit 19 and from there to the outside of the body 11 contributes nothing to the ventilation of the toe region of the shoe. Yet, first appearances may be misleading, as they are in this case. To see why, it is to be realized that the passage 25 does not open into the common conduit 19 in any which way. Rather, the tube 26, and hence its internal passage 25, are bent in the manner that may be observed in FIG. 1. This means not only that the air traveling though the passage 25 has to go around the bend, but more significantly, that it is expelled into the common conduit 19 substantially in the axial or longitudinal direction of the latter, and in a direction toward the exterior of the body 11 to boot.

As a result, there is obtained, so to say, a "reversed Venturi effect", that is the thus expelled, rather rapidly moving, air entrains the previously stagnant air contained in the common conduit 19 for joint movement with it. This, of course, reduces the speed at which such joint and commingled air stream moves through the common conduit 19; however, this speed reduction pales in comparison with the attendant manifold increase in the volume of the air traveling through the common conduit 19.

As a matter of fact, this speed reduction is a part of the design inasmuch as the energy released by it is imparted to the aforementioned stagnant air, thus causing it to move. Once such stagnant air begins to move, the pressure "just behind it", that is especially at those ends of the first conduits 17 that open into the common conduit 19 decreases. This, in turn, causes replenishment air to be drawn through the first conduits 17 and ultimately, through the respective ducts 16 and orifices 15, out of the toe region of the shoe. In this manner, there is obtained the desired toe region ventilation effect.

It may have been noticed that the passage 25 is open at all times, that is not only during the "downstroke" but also during the "upstroke", i.e. while the pressure in the chamber 22 is lower than the ambient pressure. This, of course, means that some air can be drawn into the pumping chamber 22 under such lower-pressure circumstances, thus reducing the amount of air drawn into the compartment 22 through the second conduit 18. However, since the contribution of the second conduit 18 to the ventilation effect is not that great to begin with (if at all existent), as explained above, this reduction of the amount of air flowing through the second conduit 18 has only a marginal effect if any on the overall effectiveness of the air circulation process.

Nevertheless, a one-way valve, possibly similar to the flap valve 27 but effective in the opposite direction, could be provided at or in the passage 25 to prevent the flow of air through it in a direction toward the compartment 22. In this case, though, care would have to be exercised in choosing and arranging such a one-way valve in order for it not to interfere with the above-described jet or "reverse Venturi" effect applied by the emerging air jet to the air then present in the common conduit 19, and particularly not to deflect this emerging jet.

This resilient element 28 also serves as an efficient structure for absorbing shock forces. The protuberances 29 cover substantially the whole area of the heel zone where shock protection is most needed. Each protuberance yields when required, and when doing so, the material of each yielding protuberance does not overlap itself or its neighboring protuberances. The air within the yielding protuberance is allowed to escape therefrom in multiple directions along the interconnecting channels 33, thereby achieving a uniform efficacious shock absorbing function.

Figure 6:
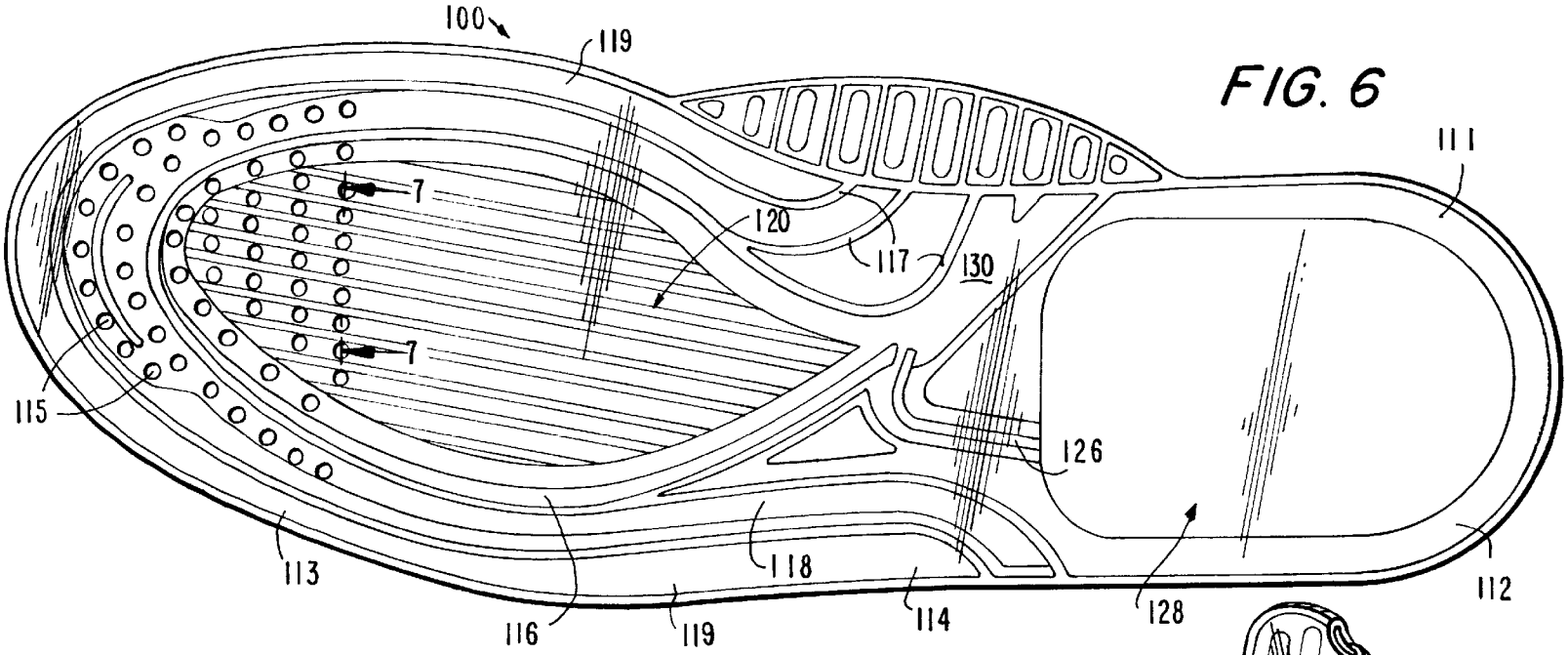
FIG. 6 is a bottom plan view analogous to FIG. 1, but of another embodiment of the present invention.
Figure 8:
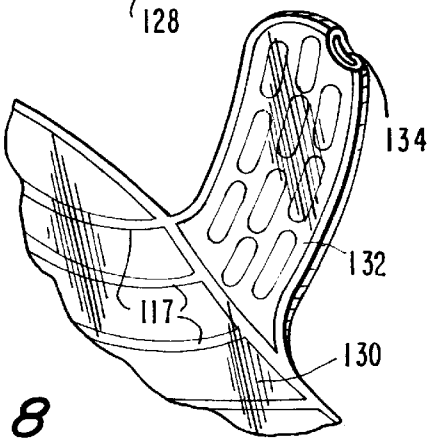
FIG. 8 is a broken-away, perspective view of a modified detail of the insert of FIG. 6.

Turning now to FIG. 6, the reference numeral 100 has been used to identify another embodiment of the structure of the present invention. As before, the structure 100 has a body 111 that includes a heel zone 112, a toe zone 113, and an arch zone 114, as well as a ball zone 116 that generally underlies the ball of a wearer's foot. Orifices 115 are arranged in rows and columns at the toe and ball zones, each orifice opening onto an exterior surface of the body 111 and communicating with first conduits 117 that individually lead to, and open onto, the instep side at one lateral zone of the structure 100, and with a second conduit 118 that leads to, and opens onto, the lateral zone of the structure at the opposite side of the instep. Air can enter and exit the structure through these open conduits.

Figure 7:
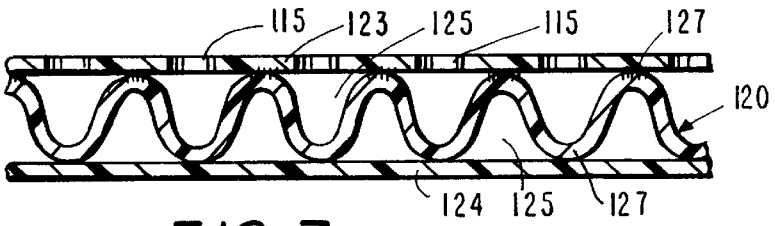
FIG. 7 is a sectional view, at a greatly enlarged scale, of a detail of the insert of FIG. 6, taken on line 7—7 thereof.

In contrast to the previous embodiment, the first and second conduits do not pass through the center of the structure, but instead, are routed around the ball zone 116 along peripheral marginal edge regions 119 of the structure. That leaves space available in the ball zone to receive a corrugated element 120. The element 120, as best seen in FIG. 7, has a sinuous cross-section and bounds with a pair of opposite major walls 123, 124, a plurality of air channels 125 that extend linearly lengthwise of the structure 100 in mutual parallelism. To fix the element 120 in position, it is fused, glued or otherwise connected at points 127 to one or both major walls 123, 124.

The element 120 allows free air movement between itself and both major walls, i.e., above and under the corrugations, and also acts as a shock absorber. The orifices 115 allow air to enter and exit the air channels 125. The air channels 125 lead to a common space 130 at which one end of a substantially rigid tube 126, analogous to tube 26 in the previous embodiment, is embedded. The opposite end of the tube 126 is connected to the interior of a pumping compartment in which a resilient element 128, identical to element 28 of the previous embodiment, is received.

The function and operation of the structure 100 is analogous to that described above for the previous embodiment and need not be repeated. During walking, air is pumped by the resilient element 128 into and through the tube 126 into the common space 130, whereupon the rapidly moving air entrains the air contained in the air channels 125 for joint movement and expulsion from the structure at the instep side thereof.

Rather than exhausting air to, or drawing air from, the instep side of the structure, which is typically partly blocked by a side wall of the shoe, another feature of this invention resides in connecting or integrally forming an elongated extension 132 at the instep. The extension 132 has internal spacers, preferably corrugated, bounding air passages that lead from the first conduits 117 and the common space 130 along its length to a port 134 located on the extension 132. The extension is constituted of a flexible material that is placed alongside the inner side wall of the shoe, thereby elevating the port 134 to a location that is not blocked by a wearer's foot. Air can now fully be drawn into, or exhausted from, the port for increased ventilation. The extension acts like a flue through which air passes through the port 134. A wearer of a shoe so equipped may be encouraged to cut or fold the extension for greater comfort and to accommodate different shoe sizes and shapes.

It will be understood that each of the elements described above, or two or more together, may also find a useful application in other types of constructions differing from the type described above.

While the present invention has been described and illustrated herein as embodied in a specific construction of a shoe insert for an athletic shoe, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A resilient, shock-absorbing, heel element for a shoe comprising:

a) a flat connecting layer lying in a plane at an outer surface of the heel element;

b) a plurality of substantially dome-shaped, hollow protuberances of elastomeric material integral with the flat connecting layer at an opposite outer surface of the heel element and bounding internal air-containing voids extending away from one side of the plane, each protuberance having a transverse dimension; and c) a channel network formed in the flat connecting layer and extending among the protuberances for establishing an air flow among the voids, the network including a plurality of longitudinal channels linearly extending in mutual parallelism between successive ones of the protuberances along respective rows each extending along a longitudinal direction, and a plurality of transverse channels linearly extending in mutual parallelism between the longitudinal channels along respective columns each extending along a transverse direction which is generally perpendicular to the longitudinal direction, at least some of the longitudinal channels intersecting some of the transverse channels, the successive ones of the protuberances along a respective row being spaced apart by a spacing which is less than said transverse dimension of a respective protuberance to enable the air flow to flow freely among the voids.

2. The resilient element as defined in claim 1, and further comprising walls bounding a compartment in which the element is contained, said compartment having an open port through which air passes into and out of the internal voids.

3. The resilient element as defined in claim 1, wherein the rows are staggered relative to one another.

4. The resilient element as defined in claim 1, wherein each protuberance lies at an intersection of a respective row and a respective column.

* * * * *